United States Patent [19]

Van Humbeeck et al.

[11] Patent Number: 4,541,317

[45] Date of Patent: Sep. 17, 1985

[54] MACHINE FOR CUTTING DOCUMENTS

[75] Inventors: Freddy J. Van Humbeeck, Keerbergen; Jean Burtin, Mol; Johnny P. Van Meenen, Deuren, all of Belgium

[73] Assignee: AGFA-Gevaert N.V., Mortsel, Belgium

[21] Appl. No.: 541,298

[22] Filed: Oct. 12, 1983

[30] Foreign Application Priority Data

Oct. 22, 1982 [GB] United Kingdom ..... 8230256

[51] Int. Cl.[4] ..... B26D 5/34

[52] U.S. Cl. ..... 83/34; 83/72; 83/209; 83/217; 83/364; 83/368; 83/559

[58] Field of Search ..... 83/209, 215, 216, 217, 83/34, 364, 365, 368, 371, 72, 55, 50, 35, 559

[56] References Cited

U.S. PATENT DOCUMENTS 3,197,353 7/1965 Williams et al. ..... 83/365 X
3,407,690 10/1968 Stanley ..... 83/371 X
4,349,997 9/1982 Hayasaka ..... 83/368 X

*Primary Examiner*—James M. Meister
*Attorney, Agent, or Firm*—William J. Daniel

[57] ABSTRACT

The present invention relates to a machine for accurately cutting documents from a web of transparent material carrying one or more opaque documents, which machine comprises a punch-type cutter which is mounted for pivotal and lateral movement and capable of automatic positioning for accurately cutting a well-defined portion of the web so as to provide series of individual documents of predetermined size. The machine is provided with a first detector for detecting the arrival of an opaque document on the web at the cutting zone, a control responsive to the detector for arresting the movement of the web, other detectors for determining the relative lateral and angular position of the document on the web with respect to the cutter and a control responsive to the other detectors for displacing the cuttering laterally and angularly to bring the same into a predetermined position with respect to the document.

13 Claims, 7 Drawing Figures

MACHINE FOR CUTTING DOCUMENTS

The present invention relates to a cutting machine suitable for cutting opaque documents from a transparent carrier web in or on which they are secured at successive regions along the web which machine provides a passageway via which said web can be longitudinally advanced along a given path through the machine for bringing successive regions along the web successively to a cutting zone in the machine.

The cutting machine of the invention is particularly suited for use in the final stage of a production line for manufacturing security documents such as e.g. identity cards, bank cards and the like.

Keeping in view present and future applications of such documents in automatic card-operated service systems for instance, one can easily understand that these documents have to come up to well-determined prerequisites regarding their overall dimensions and their dimensional stability so that manufacturing tolerances have to be kept as small as possible.

It is common practice to manufacture identification documents photographically, i.e. to record personal information upon light-sensitive surfaces.

Such a document can e.g. have the form of a photograph enclosed in an envelope of transparent plastics material, which envelope serves the dual purpose of protecting the document proper against mechanical wear and tear as well as against falsification, e.g. as is described in U.S. Pat. No. 2,932,913. Furthermore, such a document can carry additional personal information and data in the form of signatures, fingerprints, letters, words, figures, code marks, water marks, colours, etc., which all help to identify the owner in an unequivocal way.

As can be learned from GB No. 1,518,946 and GB No. 1,548,588, it is also common practice to provide such a document with a security pattern that may comprise one or more arrays of fine lines and/or an arrangement of micro-characters or the like, e.g. of the type forming the background of banknotes.

One of the main problems in the manufacture of security documents of the type referred to above is encountered in the final stage of production, viz. in the stage where a web of plastic material, supporting or enclosing a plurality of such documents, is to be cut into a number of individual security documents with well-defined and predetermined dimensions.

As the location and orientation of the documents within such carrier web is liable to vary unpredictably from one document to the next along the web, it is not sufficient merely to guide said web along a predetermined path through a cutting machine in order to have each document cut out of the web in an accurate and precise way.

On the other hand, it is extremely difficult to modify the path of such web within such cutting machine according to the position and relative orientation of each individual document with respect to the cutting machine.

In the production of documents of the type defined hereinbefore, overall production tolerances within the limits of plus or minus 0.3 mm are acceptable, but none of the known large scale processes or apparatus is capable of reaching such a high degree of accuracy throughout the whole production line.

The present invention provides a cutting machine that is capable of positioning itself automatically and accurately according to the position and orientation of each individual document in or on the web passing through said cutting machine. By making use of the present invention it is possible to mass-produce documents so that they are consistently within the foregoing close tolerances, and even within a tolerance of plus or minus 0.1 mm.

A cutting machine according to the present invention is adapted for cutting opaque documents from a transparent carrier web by which they are carried at successive regions along the web, and includes means providing a passageway via which the web can be longitudinally advanced along a given path through the machine, a cutting zone, means for bringing successive regions along said web successively to the cutting zone, means including a first detection means for automatically arresting the web in response to the arrival of an opaque document at the cutting zone as detected by first detection means, and cutting means at the cutting zone defined by a cooperating assembly of a punch and a plate of a die-cutter with the web passing therebetween, which cutting means is operatigv at the cutting zone for severing the document carrying portion from the web. The cutting means is mounted so that it is bodily movable in directions (+Y, −Y) transverse to the web path and is pivotable about an axis (M) perpendicular to the plane occupied by a web portion when at the cutting zone, and positional adjustment means is provided for effecting the transverse and pivotal movements of said cutting means. Further detection means, associated with said positional adjustment means, are provided for detecting the lateral position and angular orientation of an arrived document relative to the path of the web through said cutting zone, which further detection means functions to cause the positional adjustment means to be actuated to effect transverse and pivotal movement of the cutting means to bring the latter into lateral and angular registration with the document edges for cutting the web at predetermined positions in relation to the several edges of the document, the first and further detection means comprising photocells located on the punch side of the web path, in line with slits extending perpendicularly through said punch, and at least one cooperating light source located at the die-plate side of the web path.

The first and further detection means, respectively, comprise photocells located on the punch side of the carrier web path, in line with slits extending perpendicularly through the punch (i.e. perpendicular to the plane of movement of the carrier web in the machine) and at least one co-operating light source located at the die plate side of said web path.

The means for detecting the arrival of an opaque document at the cutting zone, i.e. the first detection means, comprise a first photocell provided at the punch side of the web path, in line with a first slit extending perpendicularly through the punch. The first slit may be provided near and parallel to a transverse edge of the punch (i.e. an edge transverse to the web path). Preferably such transverse edge is the downstream one in the direction of movement of the transparent carrier web within the cutting machine. At least one light source is provided on the opposite side of the carrier web with respect to the first photocell and punch. Light from such source or sources can pass through a central opening in the die-plate, viz. the die-opening, but this light will not impinge on the first photocell if the first slit is covered by an opaque document. The means for automatically arresting the movement of the carrier web within the cutting machine can be actuated by output signals from the first photocell so as to stop the web when the passage of light to the first photocell is prevented or restricted to a given extent by the presence of a document covering or partly covering the first slit. The means for arresting carrier web movement may comprise means for interrupting the action of the means for feeding the carrier web into the cutting zone in said cutting machine.

The further detection means are provided in order to detect the lateral and angular positions of the cutting means with respect to the location and orientation of the opaque document in or on the carrier web at the cutting zone. This further detection may comprise a second and a third photocell located on the punch side of the web path, in line with a second and a third slit respectively, such slits extending perpendicularly through the punch and being provided near and parallel to at least one longitudinal edge of the punch (i.e. an edge or edges running in the general direction of the carrier web path). Such slits are preferably provided near to one and the same longitudinal edge but they can be near opposed longitudinal edges. Preferably these second and third slits are disposed so that one of them is in the front half and the other is in the rear half of the punch area, the "front" half being taken as that which is the more downstream in the direction of the web path.

Light from the light source or sources which co-operate(s) with the second and third photocells impinges on the second cell and/or on the third cell unless the corresponding slits are covered by an opaque document. As hereinafter explained, each cell yields a signal influencing the positional adjustment means unless or until the die-cutter has been brought to a position in which the intensity of light impinging on that cell rises or falls to a predetermined value which is indicative of the fact that the associated slit is partly covered by an opaque document.

The positional adjustment means, i.e. the means for bringing the cutter into a predetermined position with respect to said opaque document, may comprise at least one driving system, e.g. an electromotor and transmission means for moving the die-cutter laterally with respect to the general line along which said carrier web is advancing within the cutting machine and for having the die-cutter pivot about an axis of rotation which is perpendicular to the plane of the carrier web when between the punch and said die-plate at the cutting zone.

The further detection means are associated with the means for positional adjustment in such a way that the lateral displacement of the cutting means is controlled by the second photocell, whereas its pivotal movement is controlled by the third photocell, the axis of rotation being located so that it passes perpendicularly through that half of the punch area in which the second slit is located.

The means for detecting the arrival of an opaque document at the cutting zone, i.e the first detection means, may furthermore comprise a fourth photocell located on the punch side of the carrier web path, in line with a fourth slit extending perpendicularly through the punch. This fourth slit may be located parallel to and forwardly of the first slit in punch. Light from the said source or sources will impinge on the fourth photocell provided the fourth slit is not covered over by an opaque document at the cutting zone. The provision of a fourth photocell and associated slit enables the means for arresting the carrier web within said die-cutter to include decelerating means which is commanded by output signals of fourth photocell and causes the web to start slowing down before it reaches its final advanced position. The decelerating system can be triggered by the arrival of an opaque document in a position in which it at least partly covers the fourth slit and the carrier web can be completely stopped the moment the leading edge of an opaque document comes in line with the first slit in the punch, i.e. at the moment that the intensity of light impinging on the first photocell is reduced to a pre-set threshold value.

The optional provision of a fourth photocell associated with a fourth slit in the punch and cooperating with a web decelerating system may be useful when the carrier web cannot be stopped at once at the moment at which the leading edge of an opaque document comes in line with the first slit in the punch, for whatever reason, e.g. when the speed of the carrier web is too high with respect to the inertia of the stopping means.

As soon as the cutting means of the present invention has taken a predetermined position with respect to the lateral and angular position of an opaque document in or on the transparent carrier web, the document is cut by means moving the punch and/or die-plate of the die-cutter towards each other.

The latter means may comprise an electromotor and transmission means, e.g. comprising at least one cam and/or lever system, which can move the punch towards the die-plate, and/or vice-versa.

The dimensions of width and length of each of the slits and the distance between the second and third slit in the punch described hereinbefore are chosen with due regard to the dimensions of the opaque document that has to be cut and to the permitted final production tolerances.

Generally, but not limitatively, the width of each of said slits is comprised between 0.1 and 0.5 mm and the length of each of said slits is equal to or greater than 5 mm.

Preferably each of the photocells in the first and further detection means is activated as soon as the intensity of the light from said source impinging on such photocell has reached or has fallen to a pre-set threshold value.

For each of the photocells the threshold value preferably corresponds with 50% of the intensity of the light which impinges on the photocell through a corresponding slit when the light is completely free from interception by an opaque document, i.e. when said slit is not covered by an opaque document.

Preferably, the cutting assembly, i.e. the punch and the die-plate of the die-cutter, is exchangeably or removably fitted in the cutting machine so as to offer thereby the possibility to substitute one assembly for another of a different gauge, depending on the actual sizes or dimensions of the documents that have to be cut.

The gauge of each such assembly is appropriate if the dimensions of its punching area substantially correspond with the dimensions of the document that has to be cut. Generally, the dimensions of the punching area are chosen so that the plastics support or envelope of a cut-out document provides a small continuous and regular rim or edging of plastics material projecting from the periphery of the opaque document.

The survey and coordination of the abovementioned means for detecting, determining, arresting, positioning and cutting can advantageously be performed by a central electronic control unit that transmits, interprets and converts the signals from said photocells for actuating each of the abovementioned means.

The means for positional adjustment of the die-cutter and for cutting the document may comprise a driving system, e.g. an electromotor, and at least one cam and/or lever means for each of the operations specified.

Spring means are preferably provided between the punch and die-plate for separating them after each cutting.

A particular machine according to the invention, selected only by way of example, and a use of such machine, will now be described with reference to the accompanying drawings wherein.

The following description refers particularly to use of the machine in the manufacture of security or identification documents such as identity cards, bank cards, etc., but the machine can be used advantageously in the manufacture of other documents such as e.g. labels, stickers, service cards, etc.

Figure 1:
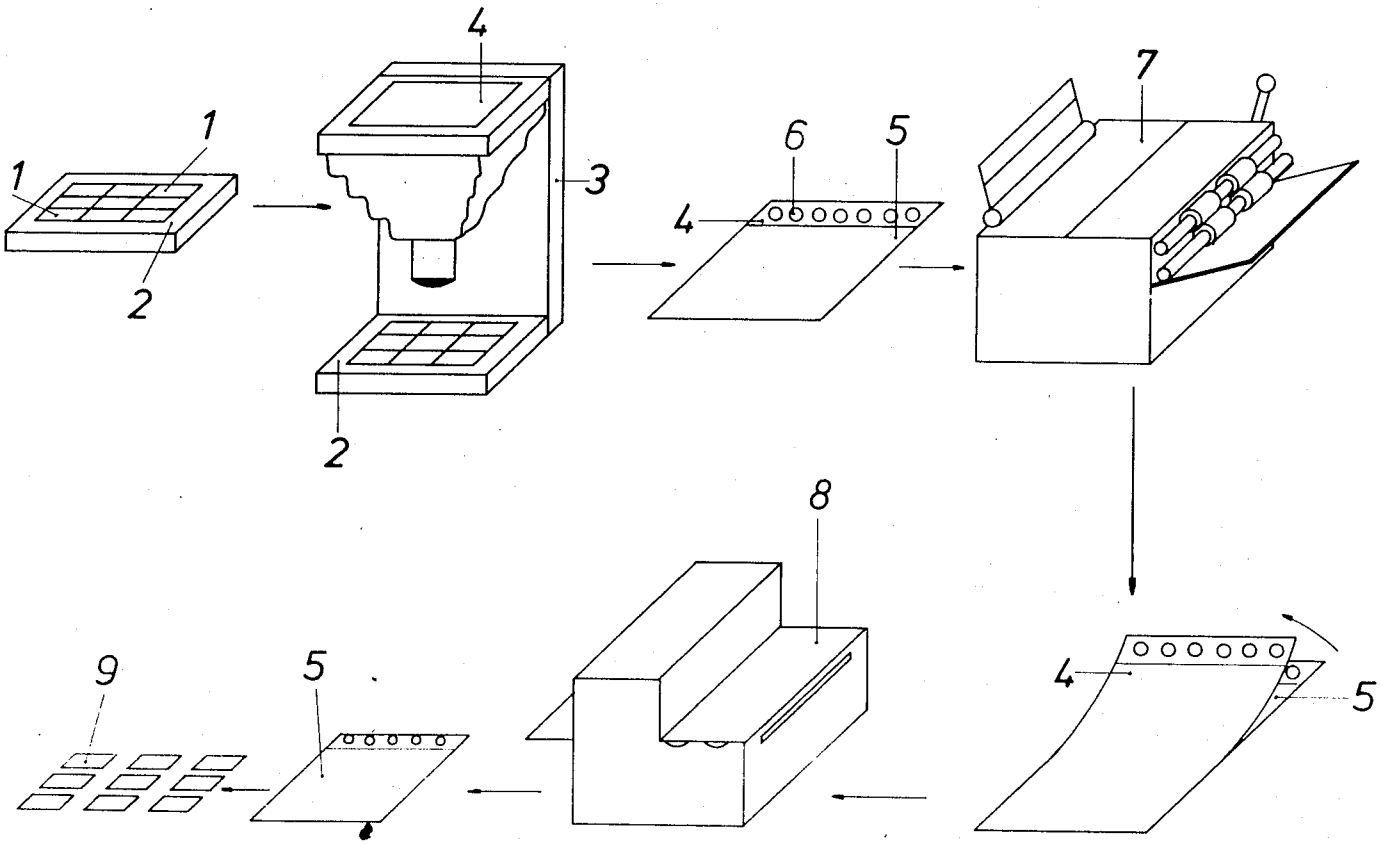
FIG. 1 is a schematic view of a photographic manufacturing process for identification documents.

In the manufacture of security documents it is common practice to lay-out a number of master cards 1 (FIG. 1) over a frame 2 to bring them perfectly aligned to each other into a reprographic camera 3, well known to those skilled in the art, and adapted for accepting said frame 2.

The photographic material used in reprographic camera 3 may be of the direct-positive or of the negative to positive type. In the method described, a negative diffusion transfer material 4 is advantageously used, wherein one transversal edge thereof is provided with registering perforations, well known in the graphics art.

After exposure, the negative diffusion transfer material 4 is made to contact a sheet of positive diffusion transfer material 5 that may bear a security pattern as defined hereinbefore.

Similar to the negative sheet 4, one transversal edge of the positive sheet 5 is also provided with a strip bearing a set of registering perforations 6, which are brought into alignment with those of sheet 4 before the negative and positive sheets 4 and 5 are taped together at their side carrying the said perforations.

Both sheets 4 and 5 are then in perfect register with one another and they are fed into a processing apparatus 7 where activation and diffusion are performed according to common diffusion transfer processes.

After diffusion, the negative sheet 4 is separated from the positive sheet 5 which is rinsed, stabilized and dried in apparatus 8.

The dry positive sheet 5 is then fed into a cutter of the type capable of cooperating with the set of registering perforations 6 on top of sheet 5 so as to meet the dimensional prerequisites for the documents proper. Sheet 5 is cut into a number of individual positive documents 9 in complete conformity with the initial master documents 1.

As already stated hereinbefore, it is advantageous to envelop documents of the type referred to between layers of transparent material in order to protect them against wear and tear as well as against falsification.

The documents can therefore advantageously be sealed up in between two protective thermoplastic, dimensionally stable, chemically and physically inert laminate webs, each of them consisting e.g. of a first layer formed of polyethylene terephthalate and a second layer of polyethylene.

For this purpose the individual documents 9 corresponding to the master documents 1 are brought into a feeder 10 (FIG. 2) where a well-known mechanism of rollers 11 and 11*a* or the like is provided for separating the documents 9 and for feeding them one by one into a laminating device 12.

A photoelectric cell 13 is provided in close vicinity of rollers 11 and 11*a* and is operationally connected with means (not shown) for actuating said rollers 11 and 11*a* in order to detect whether or not a document 9 can be inserted into laminating device generally designated 12. The laminating device 12 is well known in the art and substantially comprises two rolls 14, 15 with webs of transparent material 16, 17, each e.g. consisting of a laminate of a polyethylene terephthalate layer and a polyethylene layer.

The strips 16, 17 are unwound from the rolls 14, 15 in such a way that the polyethylene side of each of laminated webs 16, 17 is facing the inserted document to be laminated between webs 16, 17.

Microswitches, photocells or proximity switches (not shown) may advantageously be arranged at rolls 14 and 15 for providing information on the degree of consumption of each of said rolls.

Heating shoes 18, 19 locally melt the polyethylene layer in webs 16 and 17, at least partially, in order to allow the formation of a sealing bond between them and the inserted photographic document.

The thus-formed sandwich, consisting of two outer layers of laminated polyethylene terephthalate and polyethylene enveloping a plurality of photographic documents at successive regions along it, is then transported into a heat-sealing press 20, where the sandwich is press-moulded so as to finally form a single and continuous laminated transparent carrier web 21 of transparent plastics material enclosing a plurality of documents spaced apart from each other within web 21. In general, the location and orientation of documents within web 21 is liable to vary unpredictably from one document to the next along web 21.

Web 21 is then conducted through a cooling device 22 where it is cooled to room temperature.

The laminating process described hereinbefore is a continuous one, whereas the cutting, to be performed at the end of the production line, is not.

Figure 7:
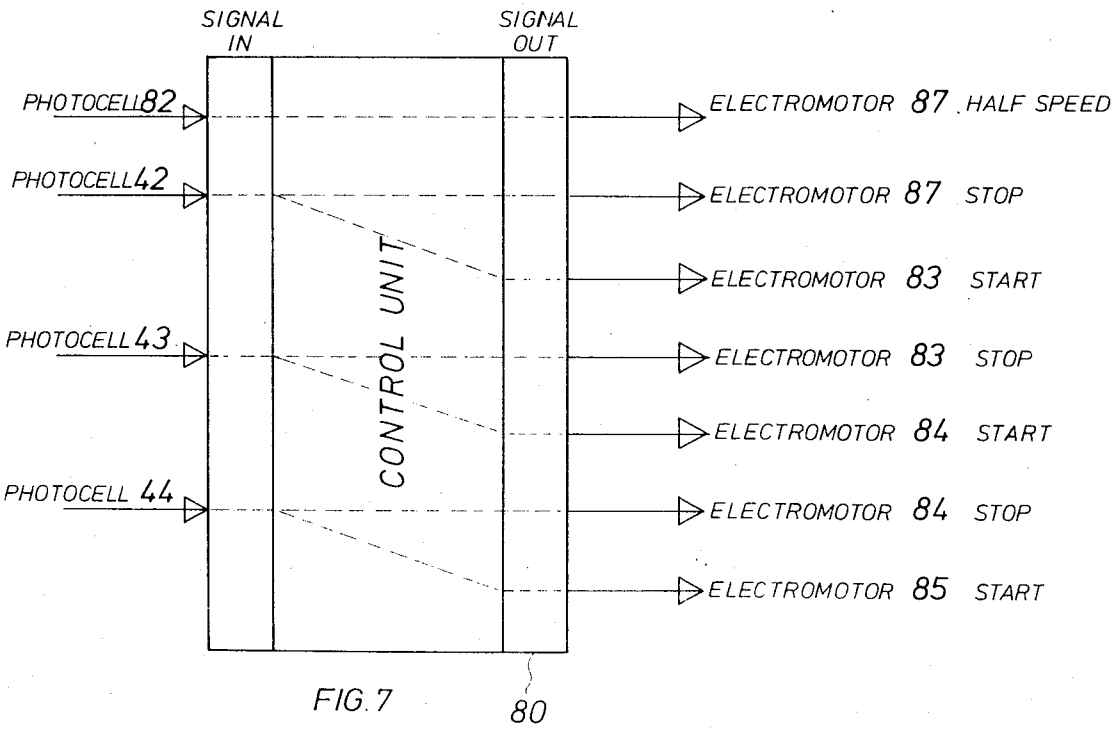
FIG. 7 is a schematic representation of the central control unit.

Therefore a buffer storage area 23 is provided so that part of web 21 is free to vary in length within area 23 defined by a minimum limit 24 and a maximum limit 25, both monitored by photocells, proximity switches or microswitches 26 and 27 respectively which can be functionally connected to a central electronic control unit 80 (represented schematically in FIG. 7) of the laminating device 12 for regulating the speed of web 21 in the continuous zone of the process.

Figure 2:
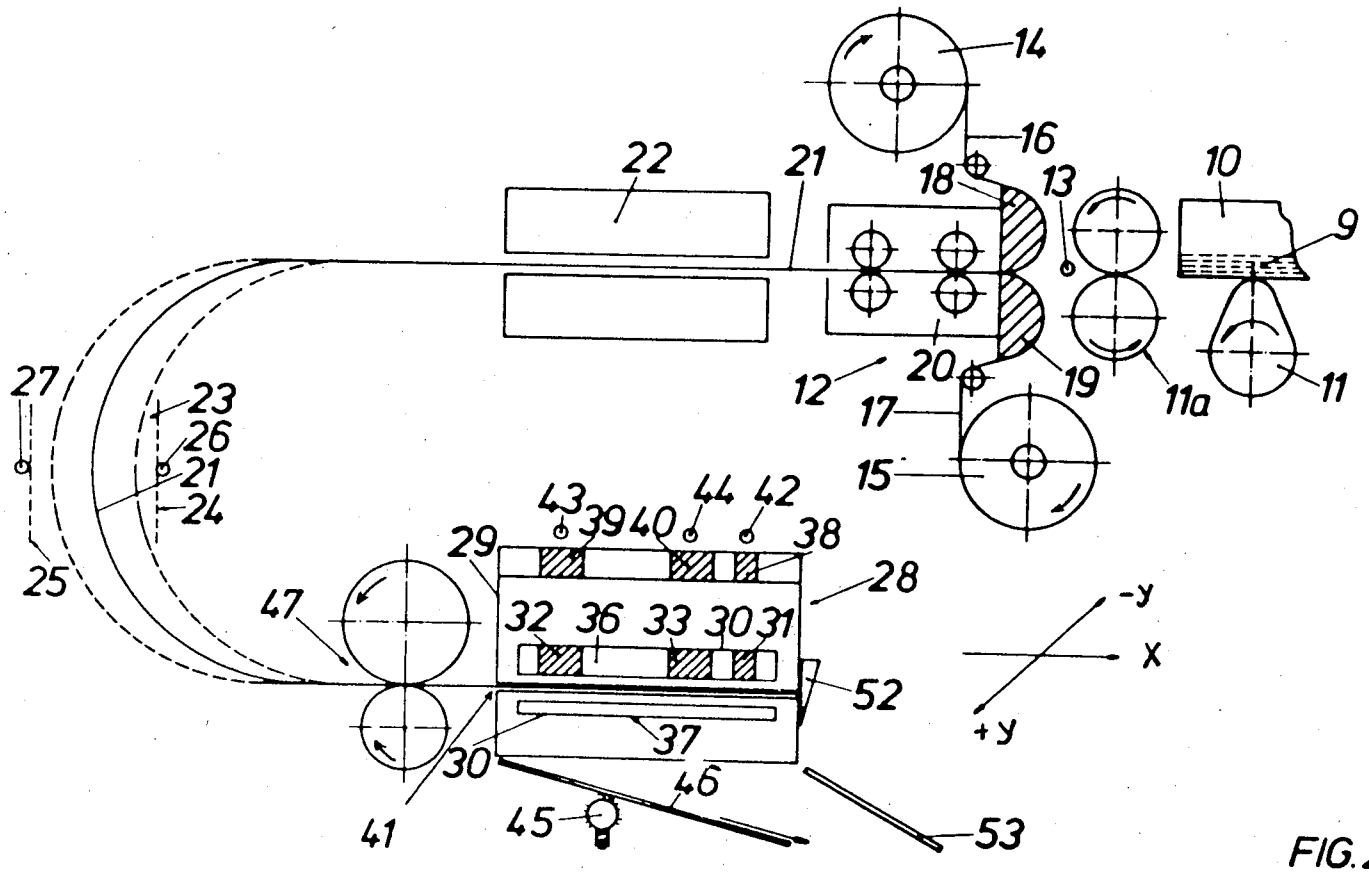
FIG. 2 is a schematic view of the production line for laminating documents and for cutting them with a cutting machine according to the present invention.

Finally, web 21 is fed into the cutting machine of the invention, generally and schematically represented by numeral 28 in FIG. 2.

The cutting machine 28 substantially consists of a pivotally and laterally movable housing 29 that may be suspended or supported by any suitable means and that defines a passageway 41 for web 21, means for detecting the presence and the relative position of an opaque document in or on transparent web 21, when at the cutting zone in housing 29, means for positioning housing 29 with respect to document and means for cutting said document from said web 21.

Housing 29 can e.g. be pivotally suspended by a stub shaft protruding from a slider which is transversely reciprocatable bodily by electromotor 83 (FIG. 4) via a crank and connecting rod. A second electromotor 84 is carried on the slider and is operationally connected through a crank and connecting rod to housing 29 thereby to change within limits the angular position of the latter (FIGS. 4 and 5) relative to the slider.

The means for detecting the presence and relative position of an opaque document 48 within housing 29 comprise a light source 45, three or four slits 31, 32, 33 and 49, respectively, in punch 36, three windows 38, 39 and 40 in housing 29, three or four photocells 42, 43, 44 and 82, respectively, which are intended for transmitting to a central electronic control unit 80 (FIG. 7) input signals which vary according to the intensity of light registered by these photocells. Central control unit 80 then produces a series of output signals depending upon the nature of the input signals and thus controls electromotor 87 (advance/stop of movement of web 21 in the longitudinal or X-direction), electromotor 83 (transverse movement in $+Y/-Y$ direction of housing 29) and electromotor 84 (pivotal or angular movement) in $+\theta/-\theta$ direction of housing 29). Electronic control unit 80 is furthermore programmed to estimate according to comparison routine based upon the input signals from the photocells whether or not housing 29 is correctly positioned with respect to the opaque document 48 in web 21. The input signals which are subject to comparison routine versus pre-set threshold values within central control unit 80 relate to the intensity of light from source 45 impinging on each of the photocells through the corresponding slits thereby to yield output signals which actuate the various electromotors. If housing 29 is not correctly laterally and angularly positioned with respect to opaque document 48, control unit 80 will produce output signals which actuate electromotors 83 and 84 for lateral and pivotal movement of housing 29 until the latter is correctly positioned with respect to opaque document 48 in web 21. In the latter event control unit 80 will then finally produce output signals which actuate electromotor 85 which is in operational connection with cam means 86 for pressing punch 36 toward die-plate 37 so as to cut out document 48 from web 21.

The cutting means comprises a die-assembly or die-cutter 30, substantially consisting of a punch 36 and a die-plate 37, which can be moved towards each other by means defined hereinafter and which can be pressed apart e.g. by spring means 81 (FIG. 4) after each cutting operation. In their spaced apart position, the said punch 36 and die-plate 37 define a passageway 41 for web 21 carrying the opaque documents. The cutting assembly 30 is advantageously fitted in housing 29 in such a way that it can easily be removed therefrom for being replaced by an other assembly that may be one of the same or of a different gauge from the original assembly, depending upon the dimensions of the documents that have to be cut, e.g.:

| | |
|---|---|
| passports | 88 × 125 mm; |
| credit cards | 53.9 × 85.7 mm. |

Web 21 can be longitudinally advanced in the X-direction through passageway 41 defined between punch 36 and die-plate 37. Die-cutter 30 is mounted so as to be free to move with respect to web 21 according to a lateral displacement, either in the $+Y$ or in the $-Y$ direction, and according to a pivotal motion about an axis of rotation M, either in the $+\theta$ or in the $-\theta$ direction (FIG. 3) as will be further described hereinafter.

The punch 36 of the die-cutter 30 comprises a set of at least three narrow slits 31, 32 and 33, the first of which, viz. 31, being provided near and parallel to that transverse edge 34 of punch 36 which is the downstream one in the direction in which web 21 is moving, viz. the X-direction, whereas in the embodiment of the present example the second 32 and third slit 33 are provided along and parallel to one and the same longitudinal edge 35 of punch 36, the distance between the latter two slits being at least equal to or greater than a quarter of the length of punch 36.

Each of slits 31, 32 and 33 is provided near and parallel to the corresponding edges 34, and 35 respectively of punch 36 and is extending perpendicularly therethrough.

The die-plate 37 of die-cutter 30 is provided with a central orifice, viz. the die-opening, that substantially corresponds to the dimensions of the document that has to be cut and that cooperates with punch 36 for cutting out a predetermined area from web 21 enclosing said document.

In a die-assembly 30 for cutting documents with dimensions as set forth hereinbefore, the length of each of said slits 31, 32 and 33 may be comprised between 5 and 20 mm, whereas their width may be comprised between 0.1 and 0.5 mm. Preferably, however, the length of each of the slits is of about 10 mm, whereas their width is of about 0.2 mm.

In housing 29 openings or windows 38, 39 and 40 may be provided, which are in line with slits 31, 32 and 33 respectively in punch 36 and which form a free passageway for the light beam from a source 45, disposed underneath the central opening in the die-plate 37, so as to permit light from source 45 to impinge on photocells 42, 43 and 44, which are in line with the pairs of slits and windows 31 and 38; 32 and 39; 33 and 40 respectively when no opaque document is covering said slits.

Each of the windows 38, 39 and 40 in housing 29 may have a width so as to provide a free passageway for light beams falling through corresponding slits in a punch of a differently gauged die-unit intended for producing security documents of other dimensions.

Light source 45 may advantageously comprise a lamp disposed under a sheet of frosted glass 46 for producing a diffuse illumination under die-plate 37 and web 21 at the cutting zone in die-cutter 30.

The working principle of the cutting machine of the present invention is as follows.

Feeding rollers 47 driven by electromotor 47 transport web 21 into the pivotally and laterally movable die-cutter 30, more particularly into passageway 41 between punch 36 and die-plate 37. The feeding rollers 47 also hold web 21 in a steady position within passageway 41 so that due to the intrinsic relative stiffness of the laminated web 21, the latter remains fixed within passageway 41 even when die-cutter 30 is positioning itself with respect to the opaque document in said web 21.

As already disclosed hereinbefore, web 21 consists of a laminar transparent plastic material enclosing at least one, but generally a plurality of photographic security documents 48, 48' . . . (FIG. 3) spaced apart from each other over a possibly variable distance A within web 21. Carrier web 21 may equally well be made of another kind of transparent material and may equally well support a document in lieu of enveloping the same. In particular cases it might even be advantageous to provide at one or at both sides of carrier web 21 an adhesive layer that may at least partly be provided with a removable protecting sheet or the like. The orientation of each of the documents as well as the distance A between two successive documents in web 21 are liable to vary unpredictably.

When web 21 is advancing longitudinally in the X-direction (FIG. 3A) along passageway 41 between punch 36 and die-plate 37 of die-cutter 30, it is stopped as soon as the leading edge 50 of an opaque document 48 is screening at least partly the light beam emitted from source 45, passing through first slit 31 in punch 36 and through the first window 38 of housing 29 and impinging on first photocell 42.

This stopping of the longitudinal movement of web 21 in the X-direction is controlled by first photocell 42 facing first window 38 and first slit 31 and can practically be realised either directly after detection of leading edge 50 of document 48 or after a programmed lapse of time after its detection by first photocell 42.

One is free to choose the threshold value at which the first photocell 42 will command the stopping of feeding rollers 47, but practically a value of 50% extinction is recommended, i.e. a light intensity equal to one half of the full light intensity that can be detected by photocell 42 in the absence of an opaque document. This reduction of the light intensity impinging on photocell 42 is due to the screening of slit 31 by a document 48.

If, however, the stopping of web 21 cannot be realized simultaneously with the detection of a document 48, e.g. due to inertia of some of the moving parts, e.g. rollers 47, it is advantageous to provide a fourth slit 49 in punch 36 parallel to first slit 31 and just upstream of the latter, i.e., in the direction from where web 21 is coming in into die-cutter 30, i.e. the opposite of direction X. The dimensional characteristics of the fourth slit 49 may be the same as those of slit 31 defined hereinbefore.

Figure 4:
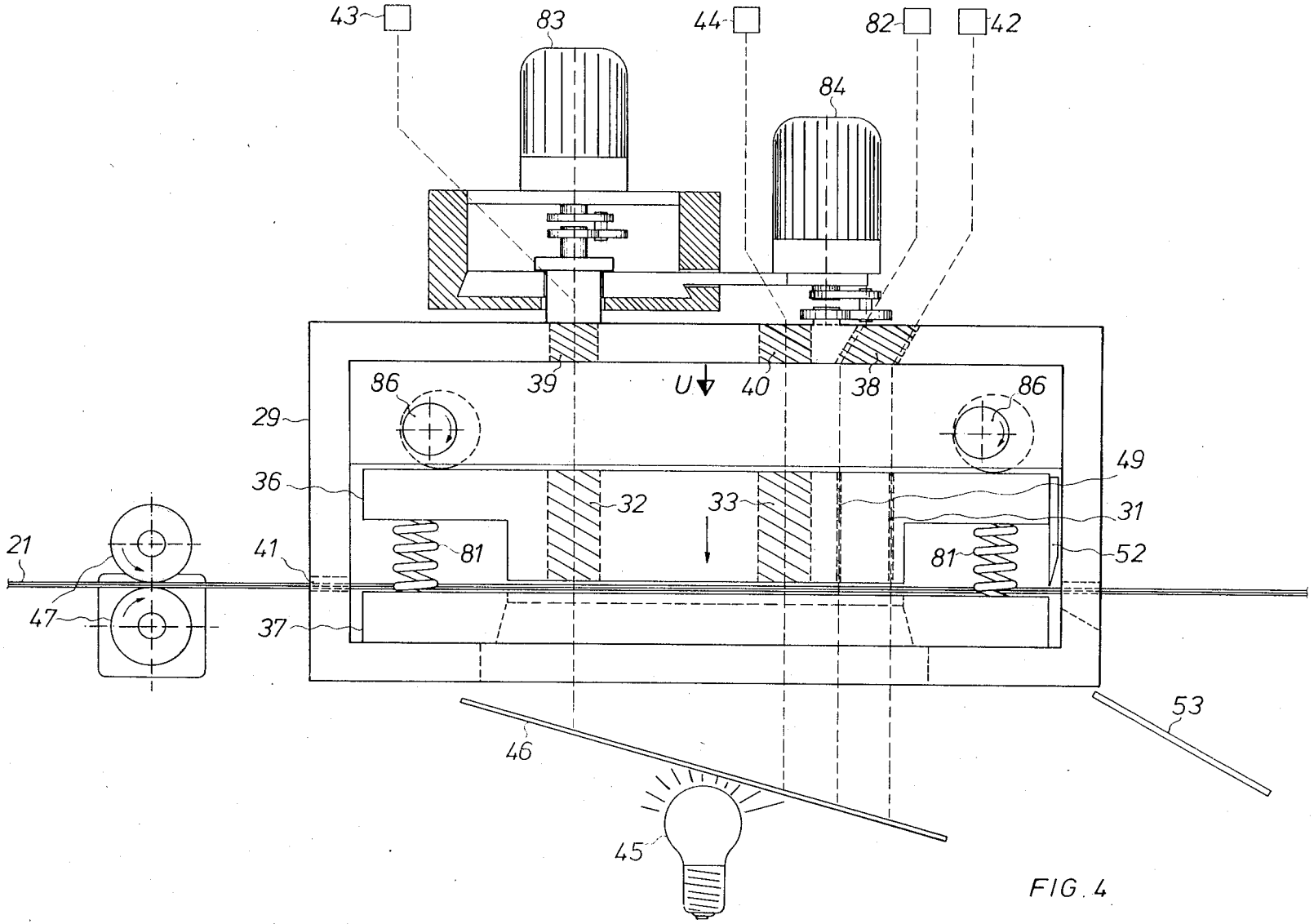
FIG. 4 is a side view in greater detail and partly in cross-section of the cutting machine of the invention wherein the optional fourth photocell is shown.
Figure 5:
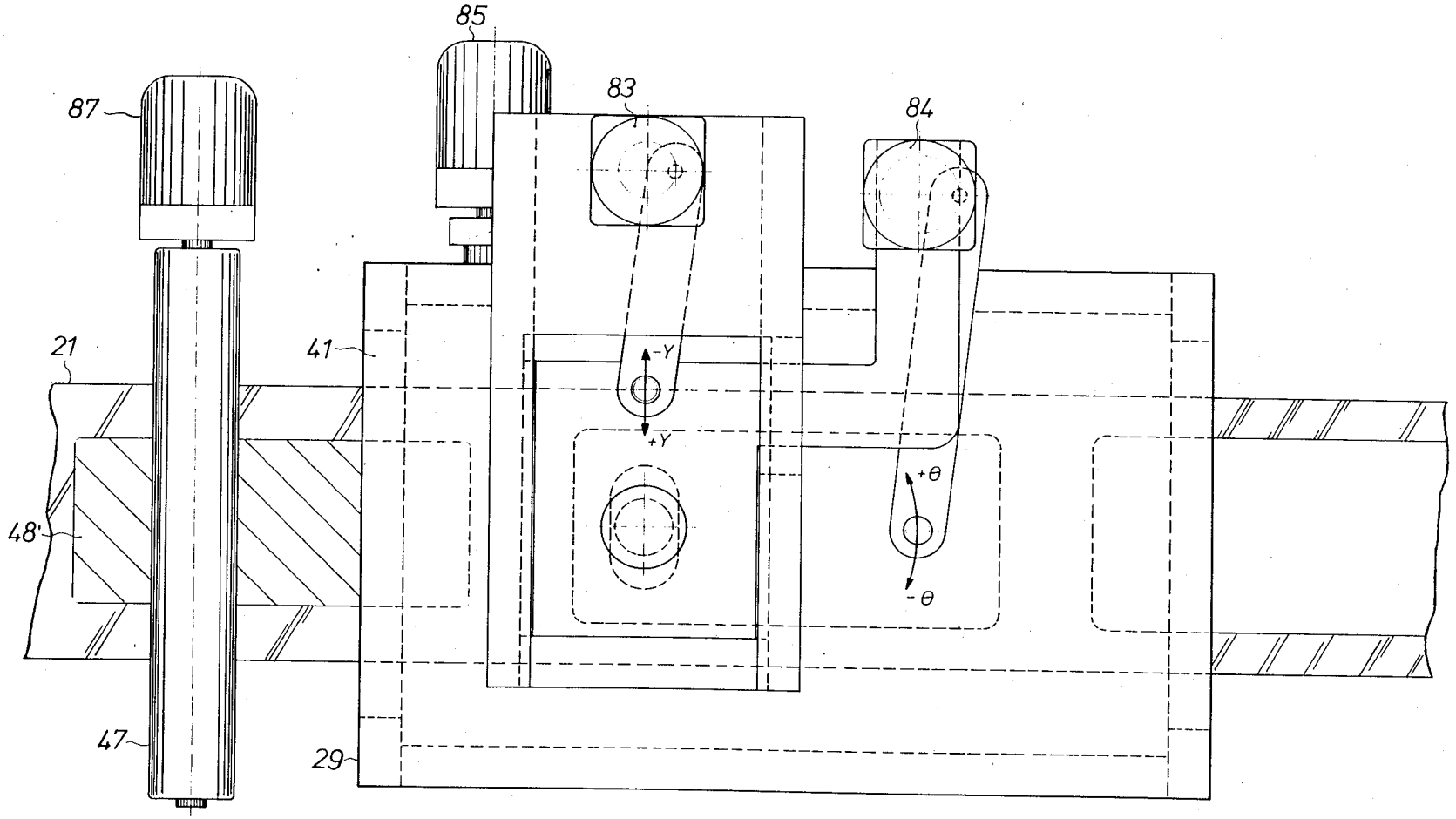
FIG. 5 is a top view of the detailed cutting machine represented in FIG. 4.

The fourth slit 49 is also extending perpendicularly through punch 36 of die-cutter 30 and may also be in line with first window 38 in housing 29 and it is associated with a fourth photocell 82 (FIG. 4).

Detection of document 48 through fourth slit 49 permits one to counteract the effect of inertia of the feeding means and allows an accurate stopping of web 21 as soon as the leading edge 50 of document 48 is at least partly screening first slit 31.

This can be realized by means which retards the speed of feed roller motor 87 so as to gradually slow down the speed of web 21 and/or stop web 21 completely, after a programmed lapse of time after the detection of document 48 through fourth slit 49, wherein the lapse of time will depend on the actual speed of web 21 (generally about 2 $m.s^{-1}$) and on the intrinsic parameters governing the stopping mechanism of feeding rollers 47 as well as on the distance between fourth slit 49 and first slit 31, such distance being, however, a constant for each individual die-assembly 30.

The means which gradually slow down and stop web 21 substantially comprise photocells 82 and 42, central control unit 80 and electromotor 87, wherein control unit 80 can be programmed so as to make web 21 stop either directly after detection of opaque document 48 (e.g. by photocell 42) or after a preset time depending on the speed of advance of web 21 (e.g. by photocell 82) or after receiving a combination of input signals from photocell 82 and photocell 42 thus producing output signals that first regard electromotor 87 to slow down the speed of advance of web 21 when opaque document 48 is detected by photocell 82, and then stop web 21 (complete arrest of electromotor 87) when opaque document 48 is detected by photocell 42. It is clear that one is free to program control unit 80 to bring web 21 to a stop at any predetermined spot within housing 29 depending on the relative position of the opaque document 48 within housing 29.

The lateral and pivotal positioning of die-cutter 30 relative to the document 48 at the cutting zone may be started as soon as web 21 has been stopped.

The lateral positioning (FIG. 3B) of die-cutter 30 with respect to the location of document 48 in web 21 passing along passageway 41 in die-cutter 30 is controlled by the second photocell 43, measuring the intensity of light from source 45 passing through second slit 32 in punch 36 and second window 39 in housing 29.

As long as full light intensity is recorded by photocell 43, housing 29 and consequently die-cutter 30 are moved into the +Y direction. If, however, document 48 is screening second slit 32, so that the light intensity being recorded by second photocell 43 is less than the preset threshold value (e.g. 50% transmission), housing 29 and die-cutter 30 are moved into the −Y direction until the longitudinal edge 51 of document 48 is covering slit 32 to the predetermined extent (e.g. 50%).

The lateral displacement of die-cutter 30, either into the −Y or into the +Y direction, may be performed by electromotor 83 that is operationally connected to second photocell 43 via central control unit 80.

Figure 3C:
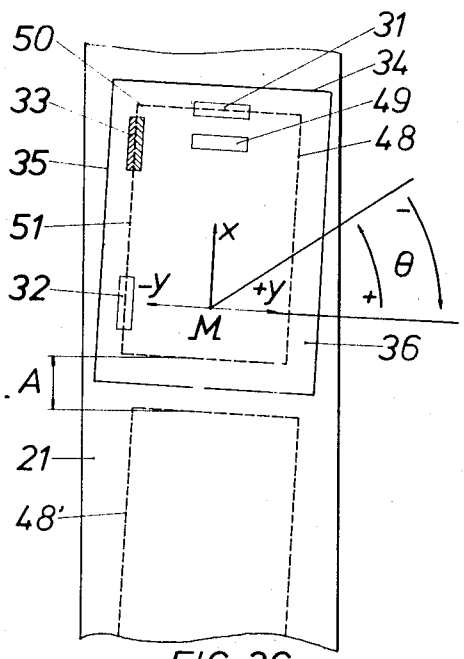
FIG. 3 is a schematic plan view of the punch of the cutting means in the cutting machine according to the present invention, in three different positions (A,B,C) with respect to an opaque document enclosed in a transparent carrier web.
Figure 3B:
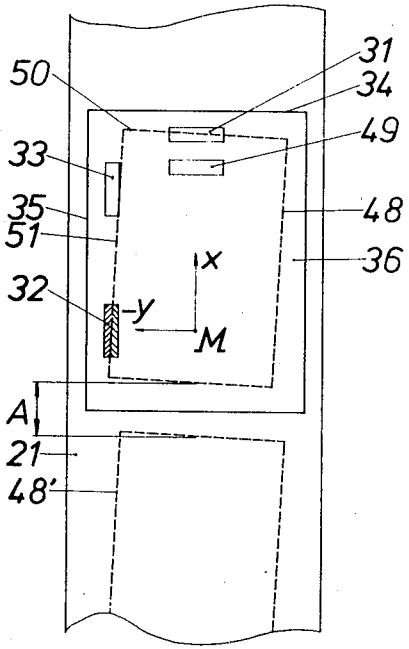

Finally die-cutter 30 has to be positioned angularly with respect to the angular orientation of document 48 in web 21 at the cutting zone (FIG. 3C). The angular displacement of die-cutter 30 may be performed by an electromotor 84 which is operationally connected via control unit 80 to third photocell 44, which is recording the light intensity through third slit 33 in punch 36 and the third window 39 in housing 29.

Figure 3A:
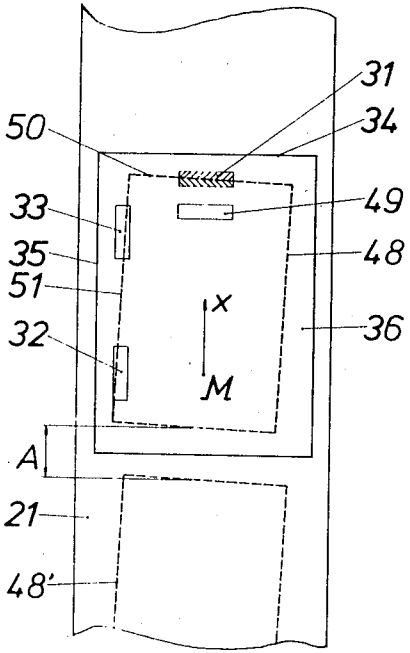

If the light intensity through third slit 33 exceeds the threshold value (e.g. 50%), die-cutter 30 is rotated over an angle $-\theta$ about rotation axis M, which is perpendicular to the plane occupied by document 48 at the cutting zone, and which is situated at the rear or tailing end of the punch, when looking in the X-direction, i.e. substantially at the same level as second slit 32, in the particular embodiment of the present example as represented in FIGS. 2 and 3A, B and C.

If, on the other hand, the light intensity does not reach threshold value, die-cutter 30 is rotated over an angle $+\theta$ about said axis M. Angular adjustment of die-cutter 30 with respect to document 48 is stopped as soon as the light intensity or the extinction measured by third photocell 44 through third slit 33 and third window 40 has reached the pre-set threshold value.

Figure 6:
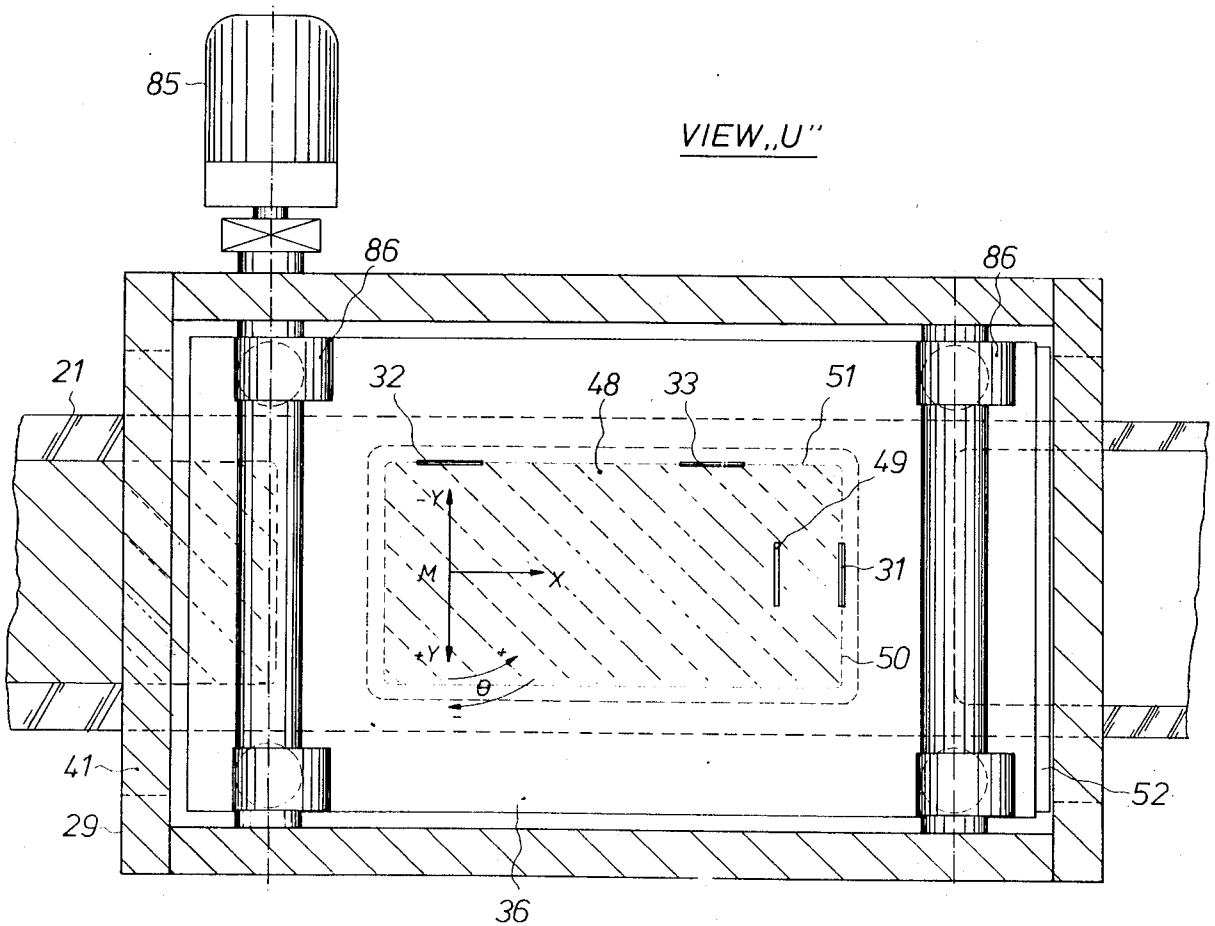
FIG. 6 is a horizontal cross-sectional view taken along line 5—5 in FIG. 4.

Die-cutter 30 is now in the appropriate position for cutting out document 48 from web 21. This may be performed by an electromotor 85 and such as cam means 86 (FIGS. 5 and 6) or lever means (not shown) that move punch 36 of die-cutter 30 towards die-plate 37 or vice versa, or both towards each other.

The die-cutter 30 is designed in such a way that the cut out document still presents beyond each of its edges a small remainder of the transparent plastics material of web 21 originally carrying the said document.

A transversal knife 52 may be provided at the front side of die-cutter 30, when looking in the X-direction, for cutting-away possible residue of surplus plastics material of web 21 ahead of document 48. The residue may be carried off via an inclined runway 53.

The sheet of frosted glass 46 described hereinbefore can advantageously be used for gathering the cut out security documents 48 falling down from the die opening in plate 37 of die-cutter 30, as it is preferably disposed as an inclined runway conveying the security documents towards a collector or the like.

The present invention is particularly, but not limitatively, suited for use in the mass production of security documents of the type described above. Such documents include e.g. identity cards, personnel cards in medium and large factories, bankcards, credit cards, personal medical data cards, etc. and have to adapt to different and very particular premises as to their internal and external structure, dimensions, chemical and physical stability, durability and with the intrinsic security pattern required for each kind of application.

As already stated hereinbefore, machines according to the present invention, can also advantageously be used in the manufacturing of other kinds of documents, such as e.g. labels, stickers, service cards and the like. The transparent carrier web can if desired be provided on at least part of at least one side with an adhesive layer that may be at least partly protected by a removable sheet or the like.

We claim:

1. In a cutting machine adapted for cutting opaque documents from a transparent carrier web on which they are carried at successive regions along said web, said machine including a cutting zone and a passageway via which said web can be longitudinally advanced by web feeding means along a given path through the said machine for bringing said successive regions along said web successively to said cutting zone, and having means for automatically arresting said web in response to the arrival of a said opaque document at said cutting zone as detected by first detection means and having cutting means defined by a cooperating assembly of a punch and a die plate on opposite sides of the web operative at said cutting zone for severing from the web the document-carrying portion thereof along lines corresponding generally to the front and rear and opposite side ege of said document, the improvement comprising means supporting said cutting assembly for lateral bodily movement in directions (+Y, −Y) transverse to said web path and pivotable movement bodily about an axis (M) perpendicular to the plane of the web portion passing through said cutting zone; positional adjustment means operative for effecting said transverse and pivotal movements of said cutting assembly; further detection means operatively associated with said positional adjustment means for detecting the lateral position and angular orientation of an arrived document relative to the center axis of the path of said web through said cutting machine, said further detection means being operative to actuate said positional adjustment means to effect such transverse and pivotal movement of said cutting means to bring the latter into lateral and angular alignment with the actual lateral position and angular orientation of said document on said web, said first and further detection means comprising photocells located on one side of the web path, in line with slits extending perpendicularly through said punch, and at least one cooperating light source located at the other side of said web path.

2. Cutting machine according to claim 1, wherein said further detection means comprises a second and a third photocell provided on said one side of the web path, in line with corresponding slits extending perpendicularly through said punch and each being provided adjacent and parallel to a side edge cutting line of said punch.

3. Cutting machine according to claim 2, wherein the transverse or lateral adjustment (+Y, −Y) of said cutting means with respect to a document in said carrier web is controlled by said second photocell, whereas the pivotal adjustment ($+\theta$, $-\theta$) of said cutting means is controlled by said third photocell.

4. Cutting machine according to claim 2, wherein said slits of said further detection means are both provided near the same side edge cutting line of said punch.

5. Cutting machine according to claim 2, wherein said slits of said further detection means are spaced apart longitudinally of the web path.

6. Cutting machine according to claim 1, wherein said first detection means comprises two transverse slits parallel with and at different distances from the front edge cutting line of the punch, and photocells in line with such slits.

7. Cutting machine according to claim 6, including means for retarding the speed of said web-feeding means and the photocell associated with the upstream transverse slit actuates said retarding means for slowing down said carrier web prior to its arrival at said cutting zone.

8. Cutting machine according to claim 1, wherein said means for automatically arresting said carrier web is controlled by said first photocell and comprises means for interrupting said web-feeding mans.

9. Cutting machine according to claim 1, including a housing in which said assembly of punch and die-plate is removably fitted.

10. Cutting machine according to claim 1, characterized in that said detection means compares the intensity of light received by each of said photocells through the corresponding slit with a pre-set threshold value and upon a deviation of the received intensity from said threshold value generates output signals for respectively actuating the corresponding means for automatically arresting said web and for positionally adjusting said cutting means.

11. A method of severing opaque documents of predetermined dimensions from a continuous carrier web having at least one transparent ply to which successive documents are anchored in randomly spaced apart relation along its length and in randomly variable angular orientation, which comprises the steps of advancing said carrier web carrying said documents thereon along a planar path through a cutting station which is adapted for both bodily lateral movement transversely of the direction of the carrier web through said cutting station and bodily pivotal movement about an axis perpendicular to the plane of the web passing through such station, said cutting station being operable to cut the web along lines corresponding substantially to the front and rear end and opposite side edges of said documents; detecting at a predetermined longitudinal detection locus the arrival of the front edge of a document at a longitudinal position corresponding to the front edge cutting line of the cutting station and halting the movement of said carrier web and documents in response to such detection; detecting any deviation in the actual lateral position of the document from the center axis of the web and displacing said cutting station bodily transversely to coincide with the actual lateral position of said document; detecting any deviation in the angular orientation of said document on said web from a correct orientation on said web and pivoting said cutter station bodily about said perpendicular axis to bring said cutting station into angular alignment with the actual orientation of said document; actuating the cutting station to sever the web along said cutting lines to separate the document and an adhering section of the carrier from the remainder of the carrier web; and re-initiating advance of the carrier web to repeat the sequence.

12. The method of claim 11, wherein said lateral detection is made by observing any deviation of one side edge of said document from a predetermined lateral detection locus and said angular orientation detection is made by observing any deviation of an edge of said document from a predetermined angular orientation locus after the lateral position of said cutter has been adjusted according to any deviation in the observed lateral position of a document which has been halted in said longitudinal position.

13. The method of claim 12, wherein said angular orientation point is spaced laterally from the center axis of the web path the same distance as the spacing therefrom of said lateral detection point but is longitudinally separated therefrom.

* * * * *